US008088028B2

(12) United States Patent
Jones

(10) Patent No.: US 8,088,028 B2
(45) Date of Patent: Jan. 3, 2012

(54) TRACKING SYSTEM FOR USE WITH AN ARROW

(76) Inventor: Douglas Jones, Point, TX (US)

( * ) Notice: Subject to any disclaimer, the term of this patent is extended or adjusted under 35 U.S.C. 154(b) by 45 days.

(21) Appl. No.: 12/759,139

(22) Filed: Apr. 13, 2010

(65) Prior Publication Data

US 2011/0250996 A1 Oct. 13, 2011

(51) Int. Cl.
*F42B 6/04* (2006.01)

(52) U.S. Cl. ..... 473/578

(58) Field of Classification Search ..... 473/570, 473/578, 582, 583
See application file for complete search history.

(56) References Cited

U.S. PATENT DOCUMENTS 4,675,683 A * 6/1987 Robinson et al. ..... 342/386
4,704,612 A 11/1987 Boy et al.
4,749,198 A * 6/1988 Brailean ..... 473/570
4,885,800 A * 12/1989 Ragle ..... 455/98
4,951,952 A * 8/1990 Saddler ..... 473/570
5,134,552 A * 7/1992 Call et al. ..... 362/203
5,141,229 A * 8/1992 Roundy ..... 473/570
5,157,405 A 10/1992 Wycoff et al.
6,612,947 B2 9/2003 Porter

* cited by examiner

*Primary Examiner* — John Ricci
(74) *Attorney, Agent, or Firm* — Dale J. Ream

(57) ABSTRACT

A tracking system for use with an arrow having a shaft and arrowhead includes a housing having first and second separable portions that define an interior area. A transmitter is operatively coupled to one of the portions and positioned in the interior area when coupled together. A first anchor is configured to be coupled to the shaft and the housing first end. A second anchor is configured to be coupled to the arrowhead and the housing second end. A fastener selectively couples the first and second portions together. A switch activates automatically when the fastener is moved to couple the first and second portions together and causes the transmitter to activate. The system includes a tracking unit having a receiver, display, processor, and programming to indicate a location of the transmitter based on signal received by the receiver from the transmitter. Data received from the transmitter may include an identifier.

16 Claims, 5 Drawing Sheets

TRACKING SYSTEM FOR USE WITH AN ARROW

BACKGROUND OF THE INVENTION

This invention relates generally to tracking devices and, more particularly, to a tracking system for use with an arrow such that the arrow may be located and retrieved after being shot with a bow or crossbow.

Bow hunters have a desire to locate and retrieve arrows that have been shot while hunting, especially because of the expense of replacement arrows and also for the convenience of not having to acquire new arrows. In addition, most hunters consider it inhumane to allow an animal to wander away with an arrow lodged in its body after being shot. Locating shot arrows can be very difficult in that a hunting arrow may include a camouflage color pattern that blends in with surrounding brush, the arrow may have traveled a relatively long distance after missing its intended target, or the arrow is lodged in an animal that is able to run away—the arrow being most likely to stay in the animal if shot quartering away).

Various devices have been proposed in the art for tracking the location of a shot arrow. Although assumably effective for their intended purposes, the existing devices and patent proposals do not provide a serialized radio insert assembly as well as a separate handheld tracking unit capable of tracking multiple arrows simultaneously and without confusion.

Therefore, it would be desirable to have a tracking system for use with an arrow that includes a transmitter positioned in a housing that is capable of insertion into an arrow. Further, it would be desirable to have a tracking system having a receiver positioned in a case for receiving signals from the transmitter indicative of a location of the transmitter. In addition, it would be desirable to have a tracking system that is able to track multiple arrows according to respective unique identifiers.

SUMMARY OF THE INVENTION

A tracking system for use with an arrow having a shaft and arrowhead includes a housing having first and second separable portions that define an interior area. A transmitter is operatively coupled to one of the portions and positioned in the interior area when coupled together. A first anchor is configured to be coupled to the shaft and the housing first end. A second anchor is configured to be coupled to the arrowhead and the housing second end. A fastener selectively couples the first and second portions together. A switch activates automatically when the fastener is moved to couple the first and second portions together and causes the transmitter to activate. The system includes a tracking unit having a receiver, display, processor, and programming to indicate a location of the transmitter based on signal received by the receiver from the transmitter. Data received from the transmitter may include an identifier.

Therefore, a general object of this invention is to provide a tracking system for locating an arrow.

Another object of this invention is to provide a tracking system, as aforesaid, having a transmitter positioned in a housing for selective insertion into an arrow shaft.

Still another object of this invention is to provide a tracking system, as aforesaid, in which each transmitter is associated with an identifier.

Yet another object of this invention is to provide a tracking system, as aforesaid, having a tracking unit that includes a receiver configured to receive signals from the transmitter.

A further object of this invention is to provide a tracking system, as aforesaid, in which the tracking unit includes a processor for determining a position of the transmitter based on signals received by the receiver.

A still further object of this invention is to provide a tracking system, as aforesaid, in which the tracking unit includes a display for displaying the position of the transmitter.

A particular object of this invention is to provide a tracking system, as aforesaid, in which the tracking unit displays the identifier associated with a respective transmitter.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
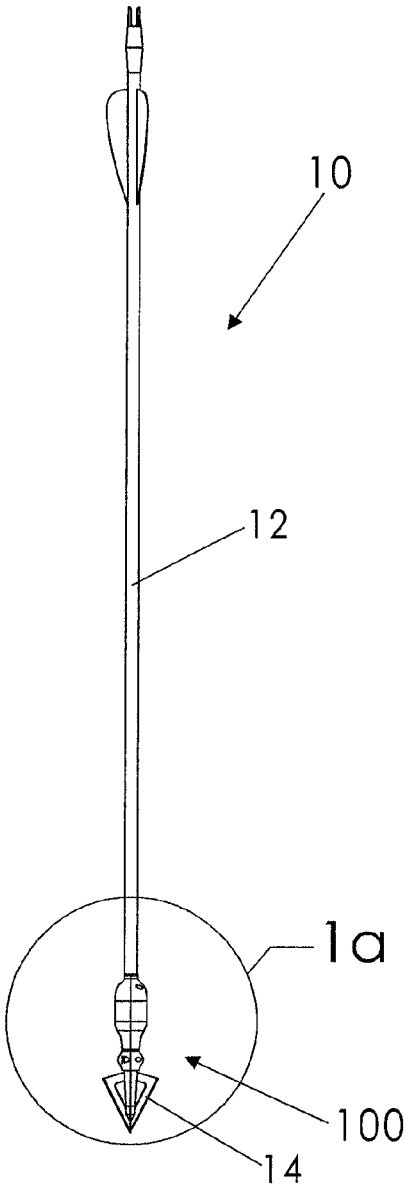
FIG. 1 is a perspective view of a transmitter housing in use on an arrow according to a preferred embodiment of the present invention.

Tracking systems according to the present invention will now be described in detail with reference to FIGS. 1 through 5 of the accompanying drawings. More particularly, a tracking system 100 for use with an arrow 10 having a shaft 12 and an arrowhead 14 according to one embodiment includes a housing 110, anchors 120, 130, and a transmitter 140.

Figure 1A:
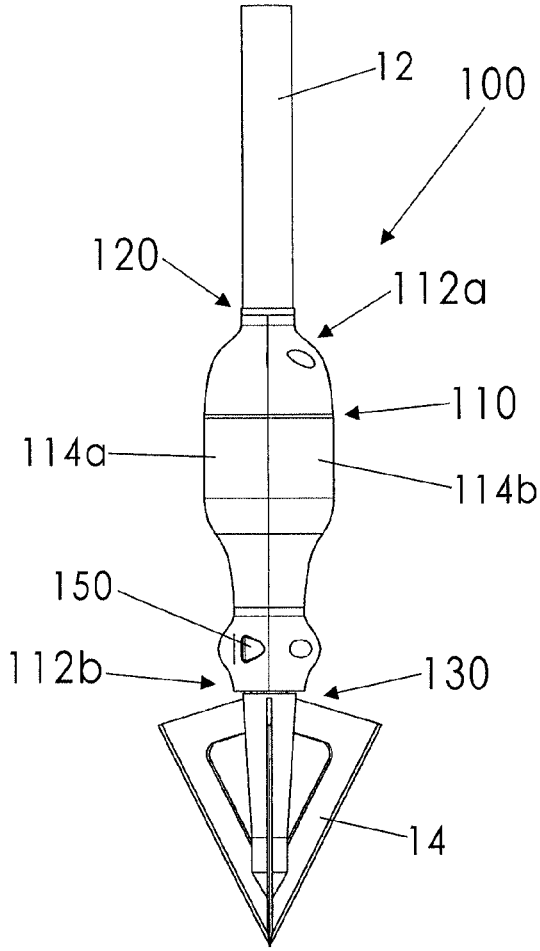
FIG. 1*a* is an isolated view on an enlarged scale taken from FIG. 1.
Figure 2:
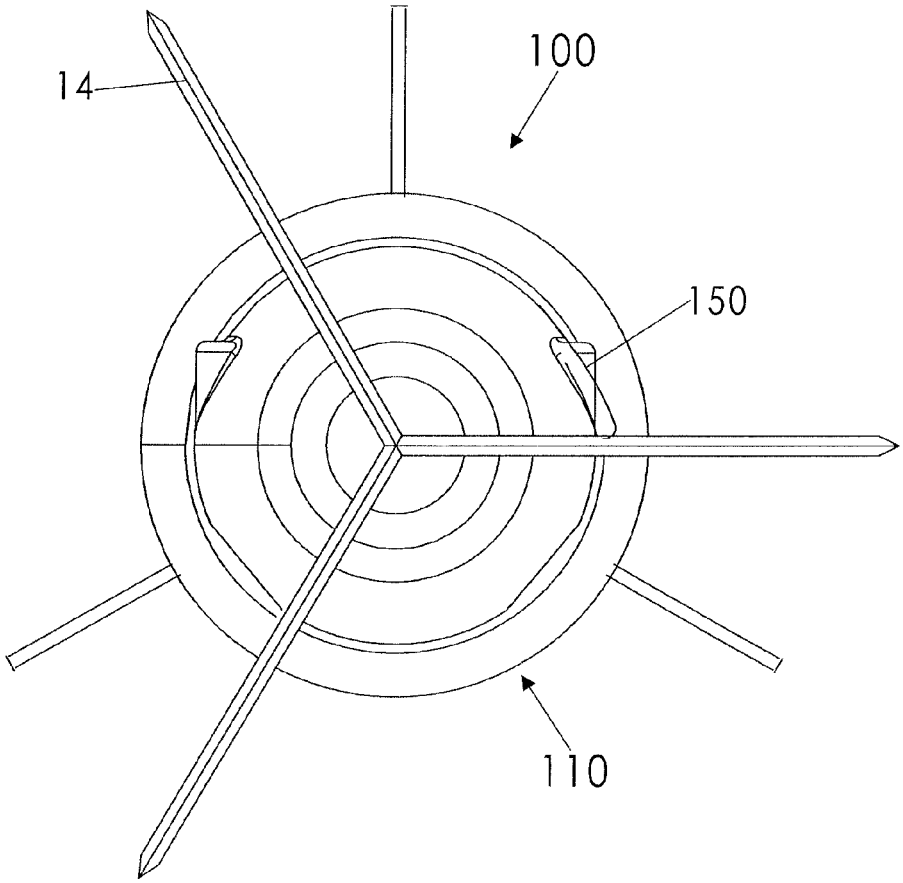
FIG. 2 is a front end view of the housing in use on an arrow as in FIG. 1*a;*
Figure 3:
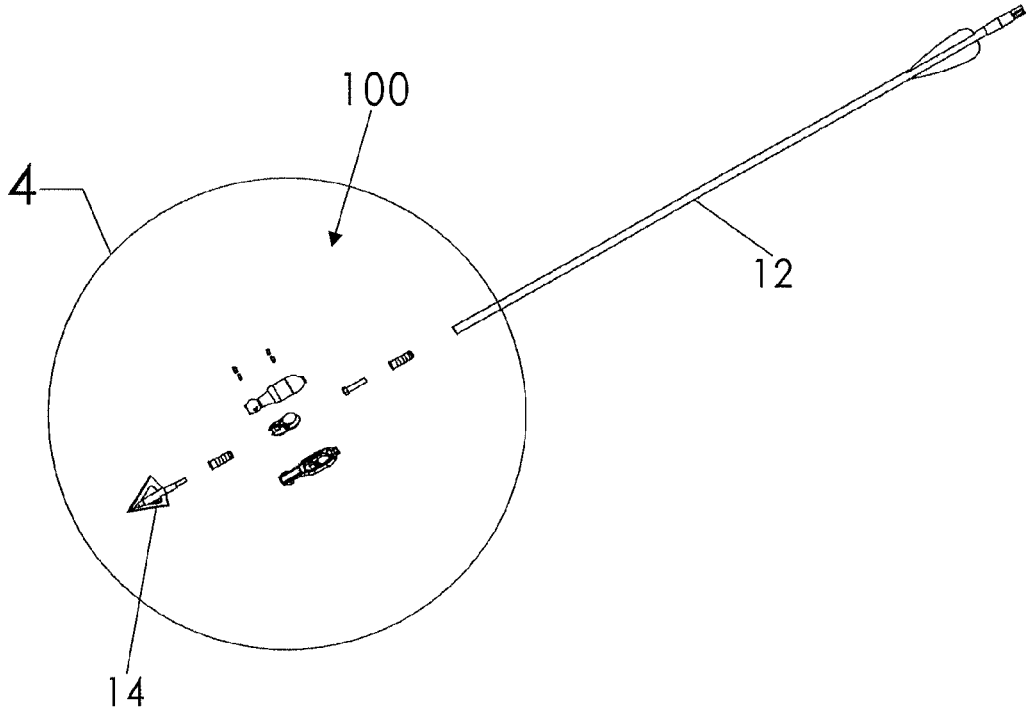
FIG. 3 is an exploded view of the transmitter housing as in FIG. 1*a;*
Figure 4:
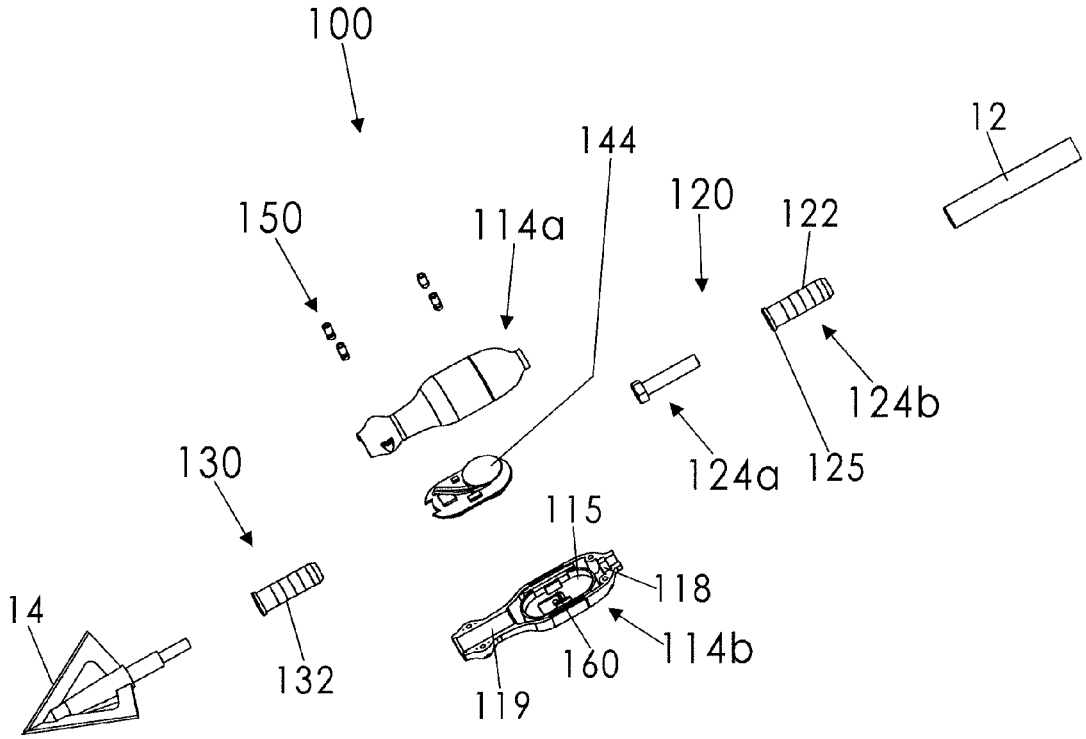
FIG. 4 is an isolated view on an enlarged scale taken from FIG. 3.

The housing 110 has opposed first and second ends 112*a*, 112*b* (FIG. 1*a*) and first and second portions 114*a*, 114*b* separable from one another (FIG. 4). The first and second portions 114*a*, 114*b* collectively define an interior area that is substantially enclosed when the portions 114*a*, 114*b* are coupled together (FIGS. 1-2), and it may be desirable for the interior area to be waterproof. The interior area may include, for example, cavity 115 shown in FIG. 4. The housing 110 may be constructed of plastic, composite, wood, metal, and/or any other appropriate material.

The rear anchor 120 is configured to be coupled to the shaft 12 and the housing first end 112*a*, and the front anchor 130 is configured to be coupled to the arrowhead 14 and the housing second end 112*b*. The rear anchor 120 may be coupled to the shaft 12 through threading 122 (FIG. 4) or any other appropriate fastening method, and may be coupled to the housing first end 112*a* by a friction fit, a threaded fit, or any other appropriate fastening method. Threading 122 is configured complementary to threading inside the shaft 12 (not shown). As shown in FIG. 4, an internal portion 124*a* may thread into external portion 124*b* and may include a head 125 that is received in the housing 110 (e.g., in cavity 118) in a friction fit. Turning to the front anchor 130, the front anchor 130 may be coupled to the arrowhead 14 through threading (e.g., internal threading that is not shown in the drawings) or any other appropriate fastening method, and may be coupled to the housing second end 112*b* by a friction fit, a threaded fit, or any other appropriate fastening method. As shown in FIG. 4, threading 132 is configured complementary to threading (not shown) in cavity 119 of the housing 110. If a friction fit is used (as described regarding the rear anchor 120, for example), the anchor may need to be inserted before the first and second portions 114*a*, 114*b* are coupled together. But if a threaded fit is used (as described regarding the front anchor 130, for example), the anchor may instead need to be inserted after the first and second portions 114*a*, 114*b* are coupled together. It is understood that the housing 110 or components positioned in its interior space may be integrally formed or positioned within the arrow shaft 12 such that it is integrally connected to the shaft 12 and arrowhead 14.

The transmitter 140 (FIG. 5) is operatively coupled to the first portion 114*a* and/or the second portion 114*b* and is inside the interior area when the first and second portions 114*a*, 114*b* are coupled together. The transmitter 140 may be, for example, a radio transmitter and/or a GPS transmitter.

Figure 5:
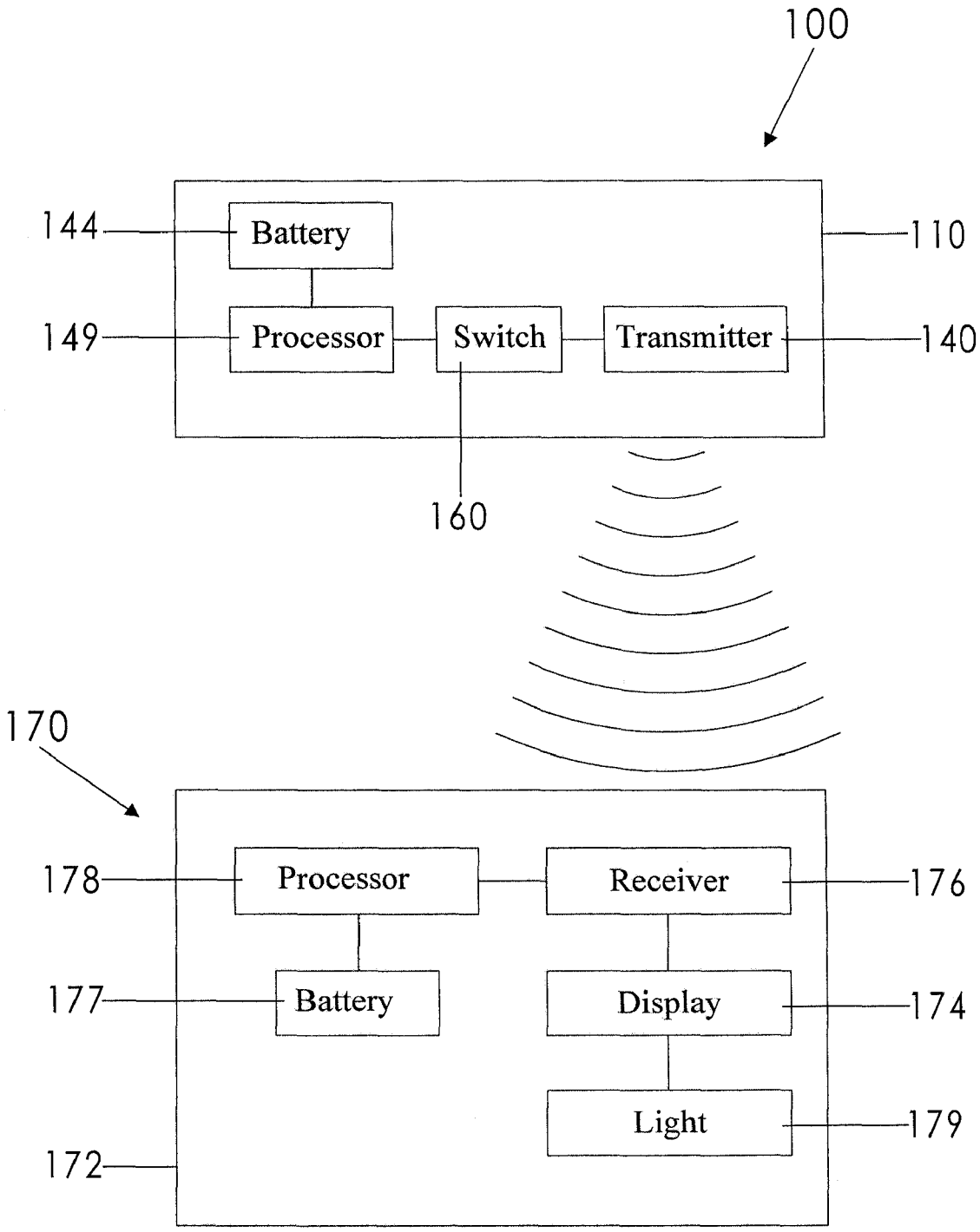
FIG. 5 is a block diagram of the electronic components of the tracking system according to the present invention.

As shown in FIGS. 4 and 5, a power source 144 (e.g., a battery) may be in electrical communication with the transmitter 140. Like the transmitter 140, the power source 144 is operatively coupled to the first portion 114*a* and/or the second portion 114*b* and is inside the interior area when the first and second portions 114*a*, 114*b* are coupled together. In some embodiments, a processor (or "transmitting processor") 149 (FIG. 5) may be in data communication with the transmitter 140 and operatively coupled to the first portion 114*a* and/or the second portion 114*b* such that it is inside the interior area when the first and second portions 114*a*, 114*b* are coupled together. The transmitting processor 149 may for example utilize programming to associate an identifier (e.g., a name or number) with signals transmitted by the transmitter 140, as described further below.

A fastener 150 selectively couples the first and second portions 114*a*, 114*b* together. The fastener 150 may be, for example, a clip or a screw (as shown in FIG. 4). Very importantly, means may be included for activating the transmitter 140 as the fastener 150 is moved to couple the first and second portions 114*a*, 114*b* together. For example, a switch 160 may be activated automatically as the fastener 150 is moved to couple the first and second portions 114*a*, 114*b* together, and activation of the switch 160 may in turn cause the transmitter 140 to activate. As shown in FIG. 4, the switch 160 may be activated pressure from the first portion 114*a* moving toward the second portion 114*b*. But other switches may alternately be employed, such as a switch adjacent the fastener 150 and activated by a tool while the tool moves the fastener to couple the first and second portions 114*a*, 114*b* together.

With focus on FIG. 5, a tracking unit 170 may be included separate from the housing 110. The tracking unit 170 includes a case 172, a display 174 (e.g., a LCD screen) operatively coupled to the case 172, and a receiver 176 operatively coupled to the case 172. A power source 177 (e.g., a battery) may be in electrical communication with the display 174 and the receiver 176, and a processor 178 may be in data communication with the display 174 and the receiver 176. A light 179 may be in communication with the display 174 to backlight the display 174 as desired. Programming may be utilized by the processor 178 to indicate on the display 174 a location of the transmitter 140 based on data received by the receiver 176 from the transmitter 140. Other programming may for example be utilized by the processor 178 to indicate on the display 174 identifying information associated with the transmitter 140 based on data received by the receiver 176 from the transmitter 140, as discussed further below.

In use, the tracking system 100 may initially be at an unassembled configuration, as shown in FIG. 4. The anchors 120, 130 may be used to couple the housing 110 to the shaft 12 and the arrowhead 14, as discussed above. As the fastener 150 is used to couple the portions 114*a*, 114*b* together, the switch 160 may automatically activate, and in turn actuate the transmitter 140. As the transmitter 140 is not activated until the fastener 150 couples the portions 114*a*, 114*b* together, the battery 144 may be conserved. It may further be very desirable for the transmitter 140 to actuate in this way, as requiring an input that is manually operable after the portions 114*a*, 114*b* are coupled together may make balancing the tracking system 100 for flight very difficult. When the arrow 10 is shot, the tracking unit 170 may be used to determine its location (which may particularly be important, and difficult to do, when the arrow 10 is lodged in an animal). More particularly, the processor 178 may utilize programming to indicate on the display 174 a location of the transmitter 140 (e.g., direction and distance) based on data received by the receiver 176 from the transmitter 140. The light 179 may be used to backlight the display 174 as desired. If the transmitting processor 149 is used to associate an identifier (e.g., a name or number) with signals transmitted by the transmitter 140, the processor 178 may indicate on the display 174 the identifying information associated with the transmitter 140 based on data received by the receiver 176 from the transmitter 140. This may allow multiple arrows and tracking systems to be respectively tracked with ease.

It is understood that while certain forms of this invention have been illustrated and described, it is not limited thereto except insofar as such limitations are included in the following claims and allowable functional equivalents thereof.

The invention claimed is:

1. A tracking system for use with an arrow having a shaft and an arrowhead, said tracking system comprising:

a housing having opposed first and second ends and having first and second portions separable from one another, said first and second portions collectively defining an interior area when coupled together;

a transmitter operatively coupled to at least one of said first and second portions and being inside said interior area when said first and second portions are coupled together;

a power source in electrical communication with said transmitter, said power source being operatively coupled to at least one of said first and second portions and being inside said interior area when said first and second portions are coupled together;

a first anchor configured to be coupled to said shaft and said housing first end;

a second anchor configured to be coupled to said arrowhead and said housing second end;

a fastener selectively coupling said first and second portions together; and means for activating said transmitter as said fastener is moved to couple said first and second portions together.

2. The tracking system of claim 1, further comprising a tracking unit, said tracking unit comprising:

a case;

a display operatively coupled to said case;

a receiver operatively coupled to said case;

a second power source in electrical communication with said display and said receiver;

a processor in data communication with said display and said receiver; and programming utilized by said processor to indicate on said display a location of said transmitter based on data received by said receiver from said transmitter.

3. The tracking system of claim 2, further comprising:

a transmitting processor in data communication with said transmitter, said transmitting processor being operatively coupled to at least one of said first and second portions and being inside said interior area when said first and second portions are coupled together;

programming utilized by said transmitting processor to associate an identifier with signals transmitted by said transmitter; and programming utilized by said processor to indicate on said display identifying information associated with said transmitter based on data received by said receiver from said transmitter.

4. The tracking system of claim 3, wherein said means include at least one of:

a switch activated by pressure from said first portion moving toward said second portion; and a switch adjacent said fastener and activated by a tool while said tool moves said fastener to couple said first and second portions together.

5. The tracking system of claim 4, wherein said transmitter is at least one of: a radio transmitter and a GPS transmitter.

6. The tracking system of claim 5, wherein:

said first anchor is coupled to said housing first end by at least one of: a friction fit and a threaded fit; and said second anchor is coupled to said housing second end by at least one of: a friction fit and a threaded fit.

7. The tracking system of claim 6, wherein said interior area is waterproof when said first and second portions are coupled together.

8. The tracking system of claim 1, wherein said means include at least one of:

a switch activated by pressure from said first portion moving toward said second portion; and a switch adjacent said fastener and activated by a tool while said tool moves said fastener to couple said first and second portions together.

9. The tracking system of claim 1, wherein said means include a switch activated automatically as said fastener is moved to couple said first and second portions together.

10. The tracking system of claim 9, wherein:

said first anchor is coupled to said housing first end by at least one of: a friction fit and a threaded fit; and said second anchor is coupled to said housing second end by at least one of: a friction fit and a threaded fit.

11. A tracking system for use with an arrow having a shaft and an arrowhead, said tracking system comprising:

a housing having opposed first and second ends and having first and second portions separable from one another, said first and second portions collectively defining an interior area when coupled together;

a transmitter operatively coupled to at least one of said first and second portions and being inside said interior area when said first and second portions are coupled together;

a first anchor configured to be coupled to said shaft and said housing first end;

a second anchor configured to be coupled to said arrowhead and said housing second end;

a fastener selectively coupling said first and second portions together; and a switch activated automatically as said fastener is moved to couple said first and second portions together, activation of said switch causing said transmitter to activate.

12. The tracking system of claim 11, wherein:

said first anchor is coupled to said housing first end by at least one of: a friction fit and a threaded fit; and said second anchor is coupled to said housing second end by at least one of: a friction fit and a threaded fit.

13. The tracking system of claim 11, further comprising a tracking unit, said tracking unit comprising:

a case;

a display operatively coupled to said case;

a receiver operatively coupled to said case;

a power source in electrical communication with said display and said receiver;

a processor in data communication with said display and said receiver; and programming utilized by said processor to indicate on said display a location of said transmitter based on data received by said receiver from said transmitter.

14. The tracking system of claim 13, further comprising:

a transmitting processor in data communication with said transmitter, said transmitting processor being operatively coupled to at least one of said first and second portions and being inside said interior area when said first and second portions are coupled together;

programming utilized by said transmitting processor to associate an identifier with signals transmitted by said transmitter; and programming utilized by said processor to indicate on said display identifying information associated with said transmitter based on data received by said receiver from said transmitter.

15. The tracking system of claim 14, wherein:

said first anchor is coupled to said housing first end by at least one of: a friction fit and a threaded fit; and said second anchor is coupled to said housing second end by at least one of: a friction fit and a threaded fit.

16. The tracking system of claim 15, wherein:

said transmitter is at least one of: a radio transmitter and a GPS transmitter; and said interior area is waterproof when said first and second portions are coupled together.

* * * * *